US005738025A

United States Patent [19]

Tachibana

[11] Patent Number: 5,738,025

[45] Date of Patent: Apr. 14, 1998

[54] METHOD AND APPARATUS FOR THERMAL CRACKING OF WASTE PLASTICS

[75] Inventor: Takashi Tachibana, Ibo-gun, Japan

[73] Assignee: Fuji Recycle Industry K.K., Hyogo, Japan

[21] Appl. No.: 412,742

[22] Filed: Mar. 29, 1995

[30] Foreign Application Priority Data

Mar. 30, 1994 [JP] Japan ..... 6-095379

[51] Int. Cl.[6] ..... F23G 5/00

[52] U.S. Cl. ..... 110/346; 110/345; 110/229; 585/241; 208/120; 208/67

[58] Field of Search ..... 110/346, 235, 110/229, 345; 208/67, 72–74, 113, 120; 585/241

[56] References Cited

U.S. PATENT DOCUMENTS

| | | | |
|---|---|---|---|
| 3,904,483 | 9/1975 | Kurihara et al. . | |
| 4,175,211 | 11/1979 | Chen et al. | 585/241 |
| 4,851,601 | 7/1989 | Fukuda et al. | 595/241 |

*Primary Examiner*—Henry A. Bennett
*Assistant Examiner*—Susanne C. Tinker
*Attorney, Agent, or Firm*—Scully, Scott, Murphy & Presser

[57] ABSTRACT

Undermelted waste plastics which have not been completely melted from the exterior of a thermal cracking vessel is introduced into a container provided in an upper position within said thermal cracking vessel and having a net-like opening, allowing the plastics to melt within said container, allowing the resulting plastic melt to drop into the thermal cracking vessel through said net-like opening, the plastic melt is thermally cracked within the thermal cracking vessel. The resulting vaporous products is introduced into a fractional distillation column to separate high-boiling products from harmful gases, non-condensable hydrocarbon gases and low-boiling products, the harmful gases, non-condensable hydrocarbon gases and low-boiling products is introduced into a halogen-containing incinerator, while re-heating the high-boiling products, a portion of the re-heated high-boiling products is recycled to said thermal cracking vessel, the remaining portion is introduced into a zeolite catalyst bed for catalytic conversion, and the residue resulting from the thermal cracking of the waste plastics in the thermal cracking step is withdrawn from the lower portion of the thermal cracking vessel.

3 Claims, 2 Drawing Sheets

METHOD AND APPARATUS FOR THERMAL CRACKING OF WASTE PLASTICS

FIELD OF THE INVENTION

The present invention relates to a method and apparatus for thermal cracking of various waste plastics to mainly obtain useful liquid hydrocarbon oils.

BACKGROUND OF THE INVENTION

It is known that polyolefinic waste plastics can be converted to hydrocarbon oils of low molecular weight by heat-melting and thermal cracking. Methods and apparatuses utilizing this knowledge have already been developed for the conversion to oils. For example, reference is here made to FIG. 2 attached hereto which schematically shows a method known generally as a method for converting polyolefinic waste plastics into oils. According to this known method, crushed plastics are melted primarily by means of an extruder disposed before an apparatus for the conversion to oil, and the thus primarily melted material is then fed to a material mixing vessel, in which it is melted completely. The completely melted material is then fed to a thermal cracking vessel and is circulated between the same vessel and a heating furnace, thereby allowing thermal cracking to take place. The resulting thermally cracked product is fed to a catalytic cracking vessel containing a catalyst. With this catalyst, the product from the thermal cracking vessel is catalytically cracked or reformed into heavy oils (corresponding to kerosene and gas oil fractions), light oil (corresponding to gasoline fraction) and light hydrocarbon gases. These oils and hydrocarbon gases are fed through a condenser to a gas holder and an oil storage tank. On the other hand, the residue by-produced in the thermal cracking is withdrawn periodically through a settler disposed in a position between the thermal cracking vessel and the heating furnace.

As a simpler method there is known a so-called batch process wherein heating is conducted every time crushed waste plastics are charged into a thermal cracking vessel to afford cracked oils.

Such conventional methods and apparatuses can be said suitable for a large-scale conversion of polyolefinic waste plastics to oil, but involve the following problems.

(1) Since the melting of material and thermal cracking are performed as separate steps, the number of apparatuses used is large and the entire process is complicated.

(2) Since various other waste plastics than polyolefinic waste plastics, as well as additives, are mixed in the starting waste plastics, harmful gases as catalyst poison are evolved within the cracked gases generated in the thermal cracking step, thus deteriorating the catalyst life.

(3) The circulated oils between thermal cracking vessel and furnace contain residuals, cokes and impurities as additions to plastics like calcium, and various metals containing in dyes. These materials stuck the connecting and inner pipelines for furnace. So, long term operations are very difficult.

(4) In the batch process it is necessary to repeat the operations of material charging, heating and coke removal, and the production of thermally cracked products is concentrated at the end of the thermal cracking reaction, thus the amount of the starting waste plastics contacted with the catalyst is not constant and hence it is difficult to attain product stabilization.

It is the object of the present invention to provide a method and apparatus for the thermal cracking of waste plastics which method and apparatus are suitable for any treatment capacity, particularly a waste plastics thermal cracking method and apparatus superior in all of economy, easiness and stability of operation and capable of relaxing restrictions on starting materials.

SUMMARY OF THE INVENTION

The waste plastics thermal cracking method according to the present invention comprises introducing waste plastics which have not been completely melted from the exterior of a thermal cracking vessel into a container provided in an upper position within the thermal cracking vessel and having a net-like opening, allowing the plastics to melt within the said container, allowing the resulting plastic melt to drop into the thermal cracking vessel through the net-like opening, cracking the plastic melt thermally within the same vessel, introducing the resulting vaporous products into a fractional distillation column to separate high-boiling products from harmful gases, such as ammonia, hydrogen chloride, cyanogen, acetaldehyde, acrylonitrile and hydrogen fluoride, non-condensable hydrocarbon gases and low-boiling products, introducing the harmful gases, non-condensable hydrocarbon gases and low-boiling products, such as lower hydrocarbons and phthalic anhydride, into a halogen-containing incinerator, while re-heating the high-boiling products, recycling a portion of the re-heated high-boiling products to the thermal cracking vessel, introducing the remaining portion into a zeolite catalyst bed for catalytic conversion, and withdrawing from the lower portion of the thermal cracking vessel the residue resulting from the thermal cracking of the waste plastics in the thermal cracking step.

The waste plastics thermal cracking equipment according to the present invention includes:

a melting and thermal cracking apparatus for melting and thermally cracking waste plastics in a single vessel, the melting and thermal cracking apparatus having a thermal cracking vessel and a container provided in an upper position within the thermal cracking vessel, the said container constituting a waste plastics melting portion and having a net-like opening, the melting and thermal cracking apparatus further having means which has a thermal cracking residue concentrating portion and which functions to remove deposits from the inner wall of the thermal cracking vessel by agitation, and means for withdrawing the thermal cracking residue from the lower portion of the thermal cracking vessel;

a fractional distillation column for separating thermally cracked, vaporous products into two groups one of which comprises harmful gases, non-condensable hydrocarbon gases and low-boiling products and the other comprises high-boiling products; and a recycle system for re-heating a portion of the high-boiling products separated in the fractional distillation column and then recycling it to the lower portion of the thermal cracking vessel.

EXPLANATION OF REFERENCE NUMERALS

1 . . . extruder

Figure 1:
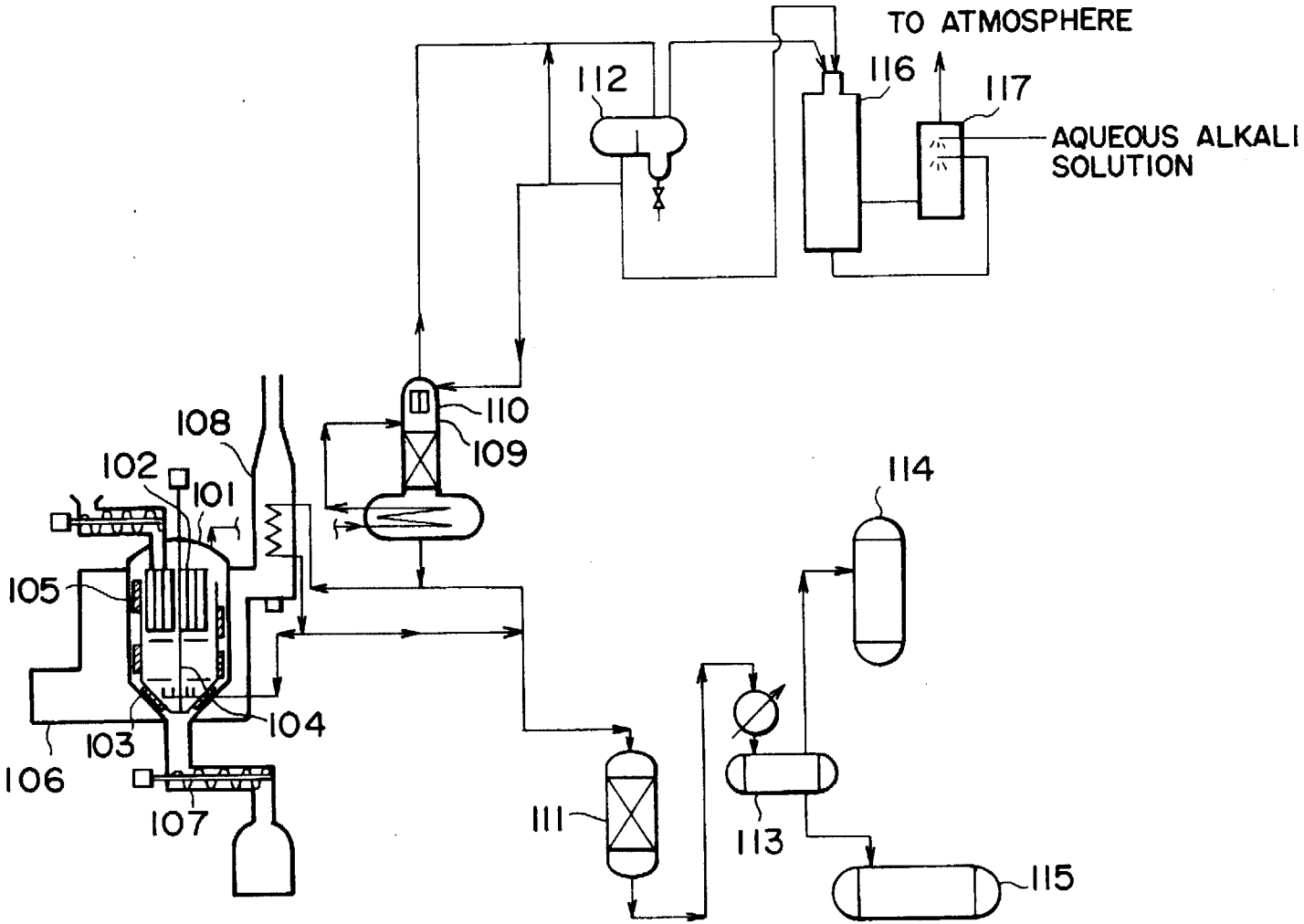
FIG. 1 is a diagram schematically showing steps suitable for practising the method of the present invention.
Figure 2:
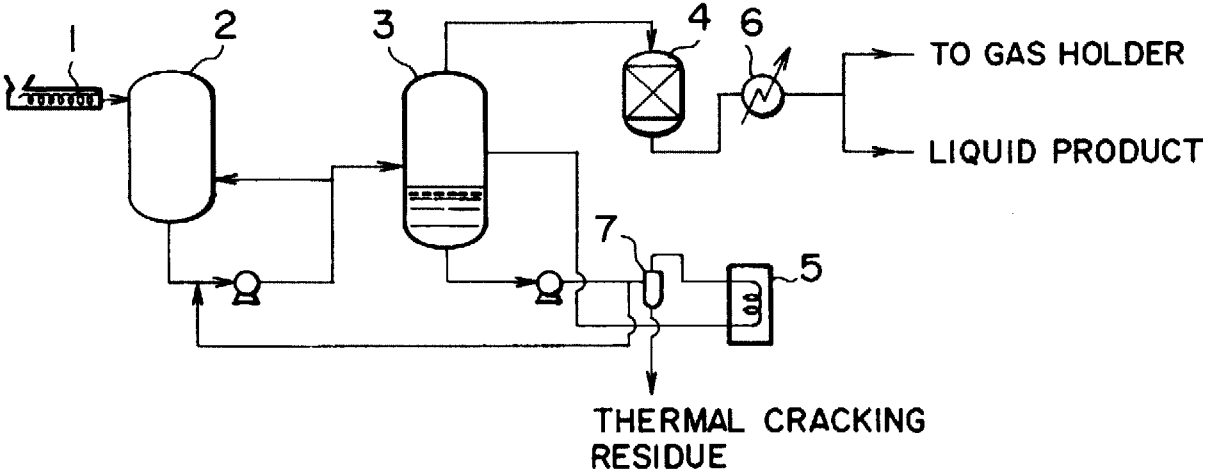
FIG. 2 is a schematic diagram for explaining a convectional known method for the conversion to oils.

2 . . . material mixing vessel

3 . . . thermal cracking vessel
4 . . . catalytic cracking vessel
5 . . . heating furnace
6 . . . condenser
7 . . . settler
101 . . . thermal cracking vessel
102 . . . waste plastics melting portion
103 . . . thermal cracking residue concentrating portion
104 . . . agitator
105 . . . scraper
106 . . . heating furnace
107 . . . screw conveyor
108 . . . conventional portion of the heating furnace
109 . . . fractional distillation column
110 . . . condenser
111 . . . zeolite catalyst bed
112 . . . condensation vessel
113 . . . receiver
114 . . . gas holder
115 . . . oil storage tank
116 . . . halogen-containing incinerator
117 . . . scrubbing tower

DETAILED DESCRIPTION OF THE INVENTION

Waste plastics to be used in the present invention are not specially limited. Examples are polyolefinic plastics such as polyethylene, polypropylene, polybutylene, polystyrene, copolymers containing those plastics as essential components, as well as chlorine- or nitrogen-containing polymers such as polyvinyl chloride, nylon and ABS.

The present invention will be described below with reference to FIG. 1.

Waste plastics are crushed using a suitable means and the crushed plastics are fed to a waste plastics melting portion 12 by the use of, for example, an extruder directly or in a softened state or a state before completely melted state, e.g. half-melted state, the waste plastic melting portion 102 being constituted by a container which is provided in an upper position within a thermal cracking vessel 101 and which has a net-like opening. The shape, structure and material of the melting portion 102 are not specially limited if only within the melting portion the waste plastics which have been introduced therein can directly be influenced by the internal temperature of the thermal cracking vessel and by thermally cracked products which are vaporous, and thereby melted and dropped through the net-like opening into the thermal cracking reaction zone of the thermal cracking vessel. In view of such plastic residues as carbide and glassy substance, however, it is desirable for the melting portion 102 to have a non-closable shape. Usually employed is a cage-like container made of iron. The mesh of the opening or the net is preferably, say, 50 mm or so.

The heating temperature in the thermal cracking vessel 101 differs, depending on the thermal decomposition temperature of the plastic material to be treated, but is usually in the range of 350° to 450° C. As to the pressure condition, no special limitation is placed thereon, but usually atmospheric pressure or a pressure close thereto is preferred. As to heating, the thermal cracking vessel itself may be heated. In this connection, a heating furnace 106 should be kept in mild heating and it is preferable that heating be conducted also from the exterior of the thermal cracking system. In the present invention, a high-boiling fraction which has been separated in a fractional distillation column 109 is conducted to a convectional portion of the heating furnace and is re-heated therein, then a portion thereof is recycled to the thermal cracking vessel. In batch operation, the heating furnace 106 should be provided, whereas in continuous operation (large capacity), it is preferable that the heating be only heating conducted outside the system.

The thermal cracking vessel comprises the waste plastics melting portion 102 described above, a device 105 for removing deposits from the inner wall of the thermal cracking vessel by agitation, the device 105 having a concentrating portion 103 for waste plastics thermal cracking residue, and a device 107 for withdrawing the residue from the lower portion of the thermal cracking vessel.

The molten plastic dropped from the waste plastics melting portion 102 is thermally cracked in the reaction zone of the thermal cracking vessel 101.

The residue by-produced in the thermal cracking reaction is accumulated in the concentrating portion 103 having a conical shape and positioned in the lower portion of the thermal cracking vessel, and is discharged as necessary by means of the residue withdrawing device. Preferably, the residue withdrawing device is a screw conveyor 107 capable of conveying a fluid of high viscosity, a slurred fluid and the like.

It is desirable that the removal of residue deposited on the inner wall of the thermal cracking vessel. In this case, there is used an agitator having blades, with a scraper 105 being fixed to the outside of each blade so as to permit removal of the deposits on the vessel inner wall.

With the agitator, not only the deposits on the inner wall of the thermal cracking vessel can be removed but also the waste plastics come to have a uniform temperature distribution during the thermal cracking reaction, whereby the thermal cracking can be done efficiently.

The products resulting from thermal cracking in the thermal cracking vessel are introduced in a vaporous state into the fractional distillation column 109. In the top of the column 109 is incorporated a condenser to adjust the column top temperature. From the column top are separated harmful gases, non-condensable hydrocarbon gases and low-boiling products, while from the bottom are separated high-boiling products. Thus, by going through the fractional distillation column, the high-boiling products are free from components which exert a bad influence on a zeolite catalyst. As a result, the catalyst life is prolonged to a great extent.

The high-boiling products thus separated from the column bottom are re-heated in the convectional portion of the heating furnace and a portion thereof is recycled to the thermal cracking vessel, whereby heat is fed to the same vessel and a convection vortex is created, thus permitting reduction of the heat transfer area of the same vessel. Further advantage is that the concentration degree of residual oil can be increased (particularly when nitrogen and light hydrocarbons are mixed into the recycle oil) and that coking during re-heating in the convectional portion can be greatly diminished in comparison with the materials staying within the thermal cracking vessel. The remaining high-boiling products are introduced into a zeolite catalyst bed 111 for catalytic conversion. These products are fed through a receiver 113 to a gas holder 114 and an oil storage tank 115.

On the other hand, the distillate from the column top is a mixture containing harmful gases, hydrocarbons and phthalic anhydride, of which phthalic anhydride forms crystals in an acid pipe or the like held at 130° C. or so. As a countermeasure, a portion of the column top condensate is re-cooled and thereafter poured into the column top pipe to wash away the resulting crystals, while at the same time the condensate temperature is controlled to about 100° C. to remove harmful gases. The crystals thus washed away are discharged periodically to the exterior from the vessel bottom portion.

The gases containing a large amount of harmful gases which are not condensed are burnt and thermally decomposed at about 1,100° C. together with a combustion improver within a halogen-containing incinerator. These waste combustion gases at high temperature are cooled rapidly and thereafter fed to a scrubbing tower, wherein acid gases (hydrogen chloride and hydrogen fluoride) which have not been decomposed are neutralized with alkali water. In this way they are discharged as pollution-free gases into the atmosphere through a stack.

The following effects are attained by the present invention.

(1) All of high economic merits, operability and versatility are ensured even in a small-scale conversion to oil.

(2) By adopting an outside-system heating method for the supply of heat to waste plastics, it becomes possible to apply the present invention to a large-scale conversion to oil.

(3) It is possible to prevent accumulation of thermal cracking residue in the thermal cracking vessel and prevent coking of the vessel inner wall, thus permitting stable operation over a long period.

(4) Since harmful gases can be removed, the treatment according to the present invention can cover a wide range of waste plastics.

What is claimed is:

1. A thermal cracking method for waste plastics, which method comprises introducing undermelted waste plastics which have not been completely melted from the exterior of a thermal cracking vessel into a container provided in an upper position within said thermal cracking vessel and having a net-like opening, allowing the plastics to melt within said container, allowing the resulting plastic melt to drop into the thermal cracking vessel through said net-like opening, cracking the plastic melt thermally within the thermal cracking vessel, introducing the resulting vaporous products into a fractional distillation column to separate high-boiling products from harmful gases, non-condensable hydrocarbon gases and low-boiling products, introducing the harmful gases, non-condensable hydrocarbon gases and low-boiling products into a halogen-containing incinerator, while re-heating the high-boiling products, recycling a portion of the re-heated high-boiling products to said thermal cracking vessel, introducing the remaining portion into a zeolite catalyst bed for catalytic conversion, and withdrawing from the lower portion of the thermal cracking vessel the residue resulting from the thermal cracking of the waste plastics in the thermal cracking step.

2. A thermal cracking apparatus for waste plastics, including:

a melting and thermal cracking apparatus for melting and thermally cracking waste plastics in a single vessel, said melting and thermal cracking apparatus having a thermal cracking vessel, a container provided in an upper position within said thermal cracking vessel, said container constituting a waste plastics melting portion and having a net-like opening, said melting and thermal cracking apparatus further having means which has a thermal cracking residue concentrating portion and which functions to remove deposits from the inner wall of said thermal cracking vessel by agitation, and means for withdrawing the thermal cracking residue from the lower portion of the thermal cracking vessel;

a fractional distillation column for separating thermally cracked, vaporous products into two groups one of which comprises harmful gases, non-condensable hydrocarbon gases and low-boiling products and the other comprises high-boiling products; and a recycle system for re-heating a portion of the high-boiling products separated in said fractional distillation column and then feeding the re-heated portion directly to the lower portion of said thermal cracking vessel to thereby effect the supply of heat into the thermal cracking vessel, formation of a convectional vortex and improvement in the degree of concentration of residual oil.

3. A method for treating harmful gases evolved in the thermal cracking of waste plastics, which method comprises cooling and condensing only relatively heavy hydrocarbons contained in a gaseous mixture issuing from the top of a fractional distillation column, said column top gaseous mixture including harmful gases selected from the group consisting of ammonia, hydrogen chloride, cyanogen, acetaldehyde, acrylonitrile, hydrogen fluoride and mixtures thereof, as well as lower hydrocarbons and phthalic anhydride; feeding the gaseous mixture portion which does not condense to a halogen-containing incinerator to decompose said mixture into pollution-free gases including $CO_2$, $N_2$ and $H_2O$ while causing acid gases to be absorbed by alkali; and thereafter discharging said pollution-free gases into the atmosphere.

* * * * *